United States Patent [19]

Stockman

[11] 4,022,270

[45] May 10, 1977

[54] FIRE DETECTOR SCANNING ARRANGEMENT

[75] Inventor: Richard Franklin Stockman, Friendship, N.Y.

[73] Assignee: The Air Preheater Company, Inc., Wellsville, N.Y.

[22] Filed: Feb. 17, 1976

[21] Appl. No.: 658,147

[52] U.S. Cl. ..... 165/5; 165/11

[51] Int. Cl.[2] ..... F28D 19/04

[58] Field of Search ..... 165/5, 11

[56] References Cited

UNITED STATES PATENTS

| | | | |
|---|---|---|---|
| 3,181,602 | 5/1965 | Johnstone | 165/4 |
| 3,730,259 | 5/1973 | Wixson et al. | 165/5 |
| 3,861,458 | 1/1975 | Ostrander et al. | 165/5 |
| 3,918,516 | 11/1975 | Carrasse et al. | 165/5 |

FOREIGN PATENTS OR APPLICATIONS

| | | | |
|---|---|---|---|
| 710,205 | 5/1965 | Canada | 165/5 |
| 1,126,466 | 9/1968 | United Kingdom | 165/5 |

*Primary Examiner*—Carroll B. Dority, Jr.
*Assistant Examiner*—Sheldon Richter
*Attorney, Agent, or Firm*—Wayne H. Lang

[57] ABSTRACT

A detector that monitors infra-red ray emission from an air preheater to detect a temperature rise that precedes a fire within the air preheater. The detector of infra-red rays is alternately moved between a "detecting" stage within the air preheater and a "cleaning" stage in clean ambient air where particulate matter deposited thereon by dirty gas may be removed to maintain the detector at a high degree of operating efficiency.

5 Claims, 4 Drawing Figures

FIRE DETECTOR SCANNING ARRANGEMENT

BACKGROUND OF THE INVENTION

1. Field of the Invention

In regenerative heat exchange apparatus a mass of heat exchange material commonly comprised of packed element plates that form a heat absorbent matrix are positioned in a hot gas passageway to absorb heat from hot gases passing therethrough. After the plates become heated by the hot gas they are suspended in a passageway for cool air where the heated plates transfer their absorbed heat to the cool air flowing therethrough.

As the hot exhaust gases are directed through the heat exchange apparatus, fly ash and unburned products of combustion carried by the exhaust gas are deposited on the surface of the packed element plates, and these deposits continue to be deposited and to build up until air and gas flow through the heat exchanger is substantially stopped. Heat is then generated in the element itself until the deposits begin to glow and cause a "hot-spot," that if not detected will rapidly increase even more until the metal of the heat exchanger will itself ignite and cause a catastrophic fire.

2. Description of Prior Art

Recent developments in the use of infra-red ray detection apparatus to detect "hot-spots" in a heat absorbent matrix of an air preheater in the manner disclosed by the U.S. Pat. No. 3,861,458 of 1975 and No. 3,730,259 of 1973 have been successful in fulfilling their stated objective of signalling a potential fire or "hot-spot" well in advance of the occurrence of a damaging fire.

In actual use, however, it has been found that placing an infra-red ray detector in an air preheater also subjects the detector to a constant flow of corrosive gases and particulate matter. A viewing means including a lens therefor exposed to such an atmosphere quickly becomes clouded with a resulting loss of viewing efficiency. Therefore, it has been determined that any response of such apparatus to a variation in infra-red rays being emitted by a "hot-spot" is also dependent upon the cleanliness of the viewing device.

SUMMARY OF THE INVENTION

This invention therefore relates to a detector of infra-red rays emanating from the matrix of rotary regenerative heat exchange apparatus that is used to transfer heat from hot exhaust gas to cooler air to be heated. The chief objective of the invention is to provide an infra-red ray detecting apparatus adapted to be intermittently disposed in the apparatus and in the ambient air in such a manner that it may be periodically cleaned without removal from the heat exchanger.

DESCRIPTION OF THE PREFERRED EMBODIMENT

Figure 1:
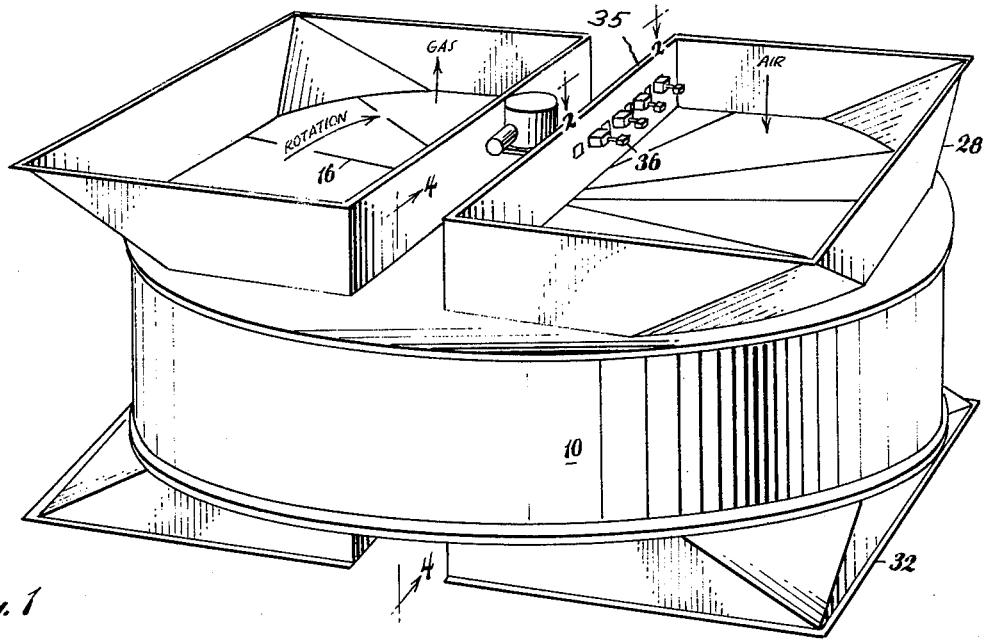
FIG. 1 is a perspective view of a rotary regenerative heat exchanger that includes the apparatus of the invention.
Figure 3:
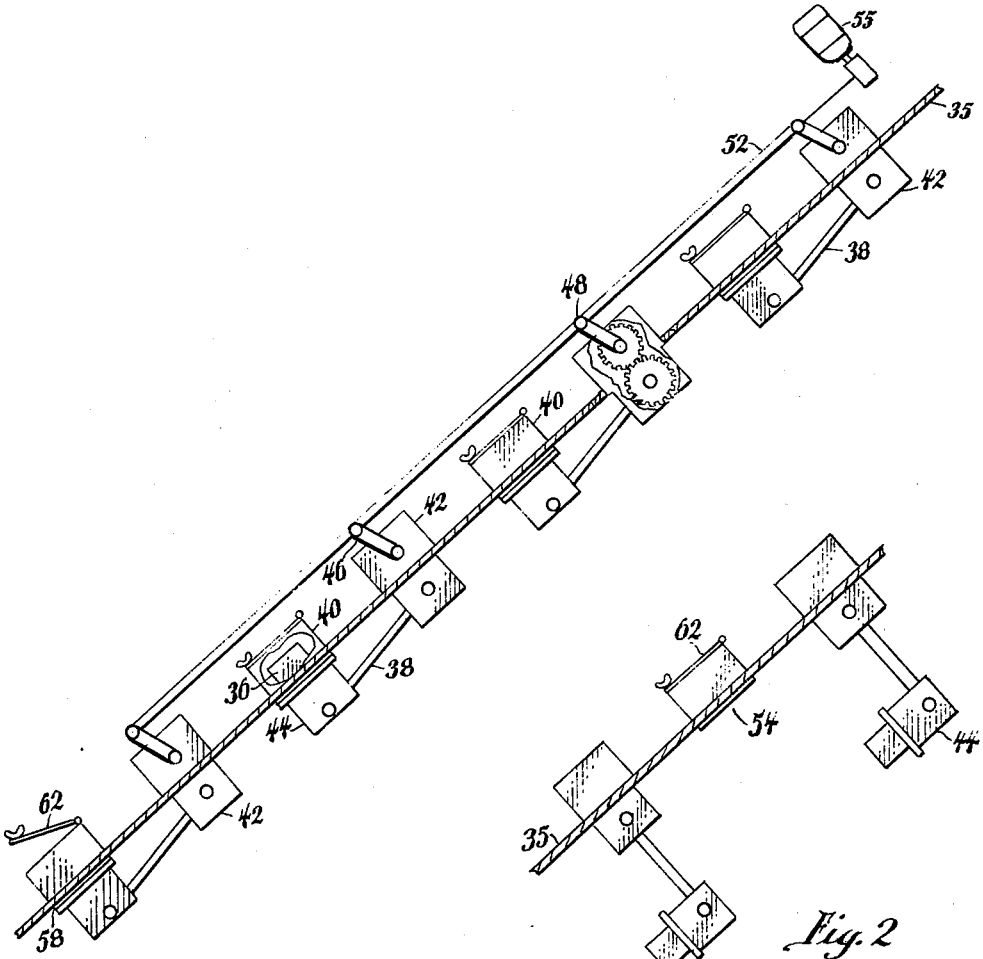
FIG. 3 is an enlarged top plan view of the infra-red detectors of FIG. 1 moved to a "closed" position.
Figure 2:
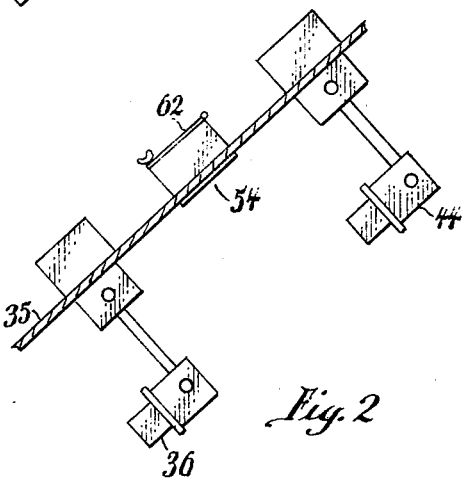
FIG. 2 is an enlarged top plan view of the detectors shown in FIG. 1.
Figure 4:
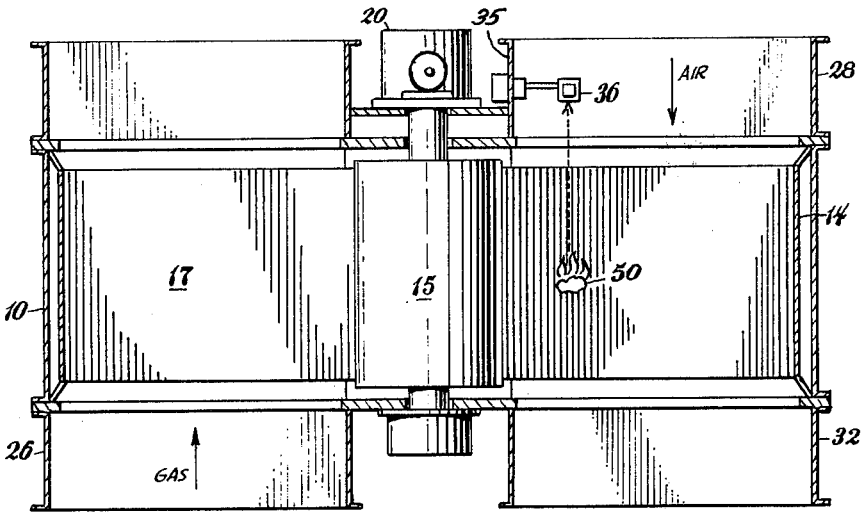
FIG. 4 is a sectional view of the device as seen from line 4—4 of FIG. 1.

In the drawing a rotary regenerative air preheater comprises a cylindrical housing 10 that encloses a rotor including a cylindrical casing 14 made up of a series of commpartments formed by radial partitions 16 extending between the casing 14 and a central rotor post 15. The compartments each contain a mass of heat absorbent material 17 in the form of corrugated plates of the like that provide passageways for the flow of fluid therebetween. The rotor is rotated slowly about its axis by a motor 20 to advance the heat absorbent element contained by the compartments of the rotor alternately between a heating fluid and a fluid to be heated. The heat absorbent plates 17 absorb heat from the heating fluid entering duct 26 of the heat exchanger from a furnace or other source of heat, and they transmit the absorbed heat to a fluid such as cool air entering the heat exchanger through a duct 28. After passing over the heated material and absorbing heat therefrom, the heated fluid is discharged through duct 32 to a boiler furnace or other place of use.

During start-up of a boiler furnace or other heat producing apparatus from which a heat exchanger receives a flow of hot exhaust gas, incomplete combustion of hydrocarbon products in the burners thereof may cause particles of unburned fuel and their products of combustion to become entrained in the gases exhausting therefrom so that they in turn become deposited upon the heat absorbent matrix of the heat exchanger. These deposits accumulate rapidly and in a short time they partially or completely block the flow of fluid over the heat exchange material. Inasmuch as these deposits are not then subjected to the flow of cooling air in a cool air stream, they will continue to increase in temperature. When they attain a temperature of approximately 700° F to 750° F, the process becomes exothermic and heat is generated within the deposits until an active fire occurs, often burning the heat exchanger and related equipment.

Testing has shown that fires start as small "hot-spots" 50 near the center of the heat absorbent matrix on collections of deposits that build up and where condensation of liquid vapors first occur. These "hot-spots" build up rapidly after their initial formation and increase in temperature to about 1400° F. When such a high temperature is attained, the metal itself of the heat exchanger usually ignites and rapidly spreads to the adjacent equipment where the entire apparatus is subject to a catastrophic fire.

Inasmuch as disastrous fires of this type first occur at a localized "hot-spot" within the heat exchanger, this invention is directed to apparatus that will detect a relatively small increase in temperature and the occurrence of such a "hot-spot" in the rotor of a heat exchanger well before a disastrous fire actually occurs.

In accordance with this invention a plurality of detectors 36 sinsitive to the variation of infra-red rays are positioned at the ends of lever arms 38. The lever arms are themselves each pivotally mounted in a gear box 42 at the side of the rotor housing in such a manner that they swing out in unison and together face the rotor as it rotates upon its axis or swing back into enclosure 40. An actuating arm 46 extends back from each box 42 a predetermined distance where it is pivotally attached at 48 to a reciprocating linkage 52, the linkage 52 being moved slowly forward and backward by any suitable prime mover 55. As the linkage 52 is slowly withdrawn, the levers 38 swing out to permit detectors 36 to "view" the adjacent rotor, but when the actuating linkage 52 is moved oppositely, the levers move in reverse to an "at rest" position where housing members 40 enclose the detectors 36. The enclosures 40 have a removable door 62 over an open side that covers opening 54 in plate 35, while a sealing ring 58 precludes the flow of fluid, when the detector 36 is drawn tightly thereto.

Inasmuch as each detector 36 includes a viewing lens that is adapted to be positioned in the flowing fluid to confront the matrix and view the infra-red rays being emitted thereby, each lens is also continuously being subjected to the contaminants carried by said fluid. Thus, the lens quickly becomes clouded so that the ray transmission of the lens and the sensitivity of the detector is quickly reduced.

When deposits accumulate on the lens of the detector to lower the transmission of infra-red rays therethrough, the viewing efficiency of the detector is impaired. The linkage 52 is then actuated and the housing members 44 with the detectors 36 therein are moved into the openings 54 to comprise a side of enclosures 40. When the detectors move over the openings 54 the sealing rings 58 preclude fluid flow therethrough so the door 62 may be opened and the particular detector to be serviced may be removed from the housing 44. After cleaning, replacement or repair of the detector 36, the door 62 is closed and operation of the detector resumed.

I claim:

1. A heat exchanger housing including inlet and outlet ducts for a heating fluid and for a fluid to be heated, a matrix of heat absorbent material carried in said housing, means for alternately subjecting said matrix to the heating fluid and the fluid to be heated, an infra-red ray detecting means positioned in the housing to view the infra-red rays emitted by the matrix, an opening in said housing adapted to receive the infra-red ray detecting means, an air lock having an enclosure with an open side thereof in common with the opening of said housing, a pivotal carrier supporting the infra-red ray detecting means, and means moving the infra-red ray detector from a position within said housing where it faces said matrix to a position within said air-lock where it covers the open side thereof.

2. A heat exchanger as defined in claim 1 including sealing means that surrounds the opening in the wall of said air lock to bridge the space between said opening and the detector when said detector is moved thereto.

3. A heat exchanger as defined in claim 1 wherein the air lock includes a removable door that gives access to the infra-red ray detector.

4. A heat exchanger as defined in claim 1 wherein the infra-red ray detecting means is mounted in the inlet duct for the fluid to be heated.

5. A heat exchanger as defined in claim 1 wherein the infra-red ray detecting means comprises a plurality of detector heads radially spaced across the inlet duct for the fluid to be heated and actuated by a single actuating rod.

* * * * *